US011259607B2

(12) United States Patent
Kelley

(10) Patent No.: US 11,259,607 B2
(45) Date of Patent: Mar. 1, 2022

(54) APPARATUS AND METHODS FOR SECURING JEWELRY

(71) Applicant: Eleven Graces, LLC, Franklin, TN (US)

(72) Inventor: Lisa Kelley, Franklin, TN (US)

(73) Assignee: Eleven Graces, LLC, Franklin, TN (US)

( * ) Notice: Subject to any disclaimer, the term of this patent is extended or adjusted under 35 U.S.C. 154(b) by 227 days.

(21) Appl. No.: 16/150,416

(22) Filed: Oct. 3, 2018

(65) Prior Publication Data

US 2019/0098967 A1 Apr. 4, 2019

Related U.S. Application Data

(60) Provisional application No. 62/567,695, filed on Oct. 3, 2017.

(51) Int. Cl.

| | |
|---|---|
| ***A44C 5/20*** | (2006.01) |
| ***A44C 15/00*** | (2006.01) |
| ***A44C 25/00*** | (2006.01) |

(52) U.S. Cl.

CPC ..... *A44C 5/2019* (2013.01); *A44C 15/0055* (2013.01); *A44C 25/001* (2013.01)

(58) Field of Classification Search

CPC ..... A44C 5/18; A44C 5/185; A44C 5/2019; A44C 5/209; A44C 5/2095; A44C 13/00; A44C 25/00; A44C 25/001; A44C 25/007; A44C 15/0055; A44C 15/005; F16B 45/00

See application file for complete search history.

(56) References Cited

U.S. PATENT DOCUMENTS

| | | | | |
|---|---|---|---|---|
| 794,695 A | | 7/1905 | Bagnall | |
| 1,086,258 A | * | 2/1914 | Wilson | B42F 1/08 24/547 |
| 1,157,917 A | * | 10/1915 | Allen | A44C 5/185 24/116 A |
| 1,159,501 A | * | 11/1915 | Kimbark | F16B 45/00 24/573.09 |
| 1,578,461 A | * | 3/1926 | Morris | A44C 15/005 63/3.1 |
| 1,933,586 A | * | 11/1933 | De Long | A44B 13/0011 24/678 |
| 2,521,589 A | * | 9/1950 | Livingston | A44C 5/209 63/20 |
| 3,224,060 A | | 12/1965 | Ogden | |
| 4,123,900 A | | 11/1978 | Sadowski | |

(Continued)

OTHER PUBLICATIONS

Beauty Necklaces Designs Pictures, Good-Looking Necklace Clasp Holder, internet.

*Primary Examiner* — Jack W Lavinder
(74) *Attorney, Agent, or Firm* — Bradley Arant Boult Cummings; Timothy L. Capria

(57) ABSTRACT

A hook comprising a body having a first coil on a first end and a second coil on a second end. The coils may be spirals curving in opposite directions. The body may be constructed of filament, such as metal wire, and may be hypoallergenic. The coils may be disposed on opposite ends of the body. An aperture may be disposed on the lower side of the body, and may be defined by a loop. A base may interface with the aperture, the interfacing base configured to interface on one side with the body and interface with a jewelry on the opposite side.

17 Claims, 6 Drawing Sheets

(56) References Cited

U.S. PATENT DOCUMENTS

| | | | | |
|---|---|---|---|---|
| 5,214,940 | A | 6/1993 | Capifali | |
| 5,279,132 | A | 1/1994 | Swaim | |
| 5,669,242 | A | 9/1997 | Cayton | |
| 6,138,356 | A | 10/2000 | Hertelendy | |
| 6,422,036 | B1 | 7/2002 | Giannis et al. | |
| D499,978 | S * | 12/2004 | Chavez | D11/86 |
| 6,848,270 | B2 * | 2/2005 | White | A44C 3/008 24/131 C |
| 7,024,886 | B1 | 4/2006 | Ito | |
| 7,552,600 | B2 | 6/2009 | Fields | |
| 7,959,489 | B2 * | 6/2011 | Shaffstall | A41F 15/02 450/86 |
| D692,792 | S * | 11/2013 | Haynes | D11/86 |
| 2003/0019242 | A1 * | 1/2003 | White | A44C 17/02 63/35 |
| 2004/0096267 | A1 * | 5/2004 | Voves | B42F 1/08 403/229 |
| 2005/0178156 | A1 | 8/2005 | McMahon | |
| 2006/0107496 | A1 * | 5/2006 | Cheng | B42F 1/08 24/67.9 |
| 2008/0022719 | A1 | 1/2008 | McMahon | |
| 2008/0256796 | A1 | 10/2008 | Fix | |
| 2010/0229356 | A1 | 9/2010 | LaRocque | |
| 2012/0324946 | A1 | 12/2012 | Latouf | |
| 2014/0250948 | A1 | 9/2014 | Gross | |
| 2015/0282574 | A1 | 10/2015 | Edmonston | |

* cited by examiner

APPARATUS AND METHODS FOR SECURING JEWELRY

This is a Non-Provisional Patent Application filed by applicant Eleven Graces, LLC for the invention by Lisa H. Kelley, a citizen of the United States, residing in Franklin, Tennessee for "Apparatus and Methods for Securing Jewelry." This application claims benefit to the priority date of U.S. Provisional Patent Application No. 62/567,695, filed on Oct. 3, 2017, the contents of which are incorporated by reference herein in their entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

All patents and publications described or discussed herein are hereby incorporated by reference in their entirety.

BACKGROUND OF THE INVENTION

The present invention relates generally to an apparatus and methods for securing jewelry on a person, particularly rotationally securing a chain necklace on a neck of the person.

Jewelry pieces are popular accessories, being, as of 2016, an estimated $70 billion dollar industry. Necklaces, whether fine jewelry or fashion jewelry, are among the most popular jewelry accessories. Among the most popular necklaces are chains, such as silver or gold, which can be worn by themselves or with additional adornments, such as pendants or beads. Typically, necklaces have a fastener or a clasp, such as a lobster claw, for securing and removing the necklace around a neck of a person. For comfort and aesthetics, it is preferable that the fastener of the necklace be positioned on the dorsal (i.e., back) neck of the wearer. However, necklaces rotationally migrate around the neck of the wearer while being worn, which results in the fastener undesirably rotating toward or on the ventral side of the body. It is not uncommon that wearers of these necklaces to rotationally adjust the necklace to position the fastener at the dorsal neck multiple times during a single use of the necklace.

What is needed then, are apparatus or methods for securing a necklace such that the fastener of the necklace remains positioned at the dorsal neck region of the wearer. These preferred apparatus or methods should facilitate rotationally securing the necklace when the necklace is being worn, especially when the subject is active (e.g., walking, running, etc.). The preferred apparatus or methods should provide for an attractive solution that is interoperable with many styles of necklaces, comfortable for the wearer, and unobtrusive and aesthetically pleasing in appearance. These needed apparatus and methods are lacking in the art.

BRIEF SUMMARY OF THE INVENTION

Disclosed herein is a hook. The hook includes a body. The body has a first coil on a first end and a second coil on a second end, wherein each of the first coil and the second coil include at least two 360° rotations. The first and second ends may be disposed oppositely on the body. The coils may be spirals. The first coil may curve in a first direction and the second coil may curve in a second direction opposite of the first direction.

The body may be constructed of a filament, such as a metal wire. The metal wire may be constructed of a hypoallergenic metal selected from the group consisting of platinum, gold, titanium, copper, stainless steel, a metal alloy substantially free of nickel, silver, sterling silver, and combinations thereof.

The body may include an aperture proximate to the first coil and the second coil. The body may comprise an upper side and a lower side, and the aperture may be disposed on the lower side and between the first coil and the second coil. The aperture may be defined by a loop of the body around an aperture axis. The first and second coils may each define a gap configured to securely receive a necklace chain.

A base may be disposed within the aperture. The base may include a first loop and a second loop opposing the first loop. Each of the first loop and the second loop may extend to respective terminating ends. At least one of the terminating ends may be configured to be received within the aperture such that the aperture of the body may be coupled with a distal end of the first loop of the base. The base may be constructed of a filament, such as a metal wire.

The body may have a profile complementary to a dorsal neck of a human subject, or wearer, so that the profile has a curved shape. The profile of the body may be substantially concave along an intersecting plane extending longitudinally along the body.

In an embodiment, a base or connector for hanging back jewelry from a neckless is provided. The connector includes a first loop extending to an enlarged first end. The connector includes a second loop opposingly extended from the first loop, the second loop extending to an enlarged second end. The first loop and the second loop each may extend from an intermediary arm, and the first loop and the second loop may be substantial mirror images of each other over a line that extends through the intermediary arm.

In an embodiment, a method of securing a necklace is provided. The method comprises providing a necklace; providing a hook including a body, the body comprising a first coil on a first end and a second coil on a second end; and looping the necklace within each of the first coil and the second coil of the body. The method may include positioning the body including the looped necklace at a dorsal neck region of a subject.

The body may include an aperture proximate to the first coil and the second coil. The method may include providing a base including a first loop and a second loop opposing the first loop, wherein each of the first loop and the second loop extend to respective terminating ends; inserting the terminating end of the first loop within the aperture of the body; and guiding the base within the aperture such that the first loop intersects with the aperture. The method may include coupling a jewelry with the second loop.

It is therefore a general object of the current disclosure to provide a hook and method for rotationally securing a necklace on a wearer.

Another object of the current disclosure is to provide a hook and method that are interoperable with different styles of necklaces.

Yet another object of the present disclosure is to provide a hook for rotationally securing a necklace that is hypoallergenic.

A further object of the instant disclosure is to provide a hook that is aesthetically pleasing and may further support a second piece of jewelry.

Other and further objects, features and advantages of the present disclosure will be readily apparent to those skilled in the art upon reading of the following disclosure.

DETAILED DESCRIPTION OF THE INVENTION

Figure 1:
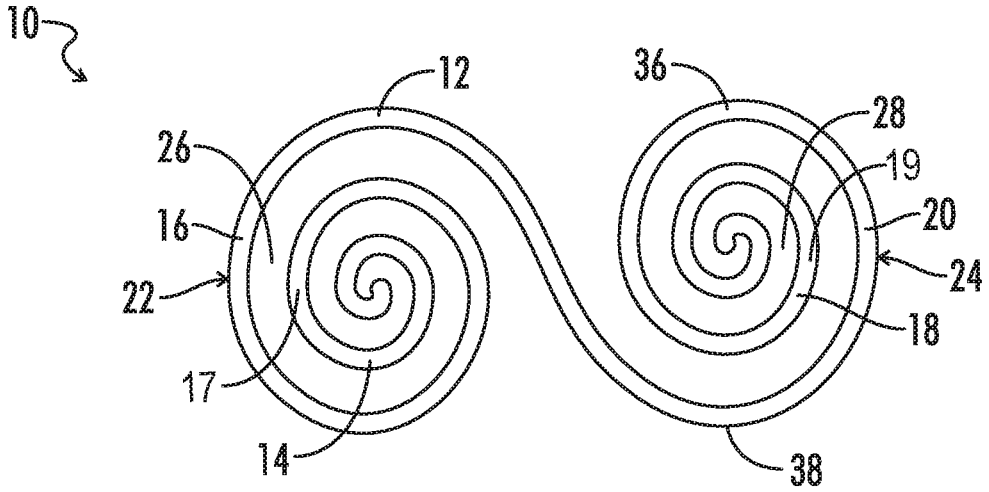
FIG. 1 illustrates a front elevation view of an embodiment of a hook.

Referring now to FIGS. 1-10, a hook 10 for securing jewelry 2 is disclosed herein. The hook 10 includes a body 12. The body 12 may be constructed or described as a filament. As used herein, "filament" means a slender, wire-like structure, such as jewelry wire. The filament may have a gauge (or equivalent dimension to gauge in embodiments not constructed of wire) of from 6 to 30 or from 15 to 22, or any subrange thereof. In one embodiment, the thickness of the filament is substantially equal to the thickness of the jewelry 2 being secured. The body 12 may be constructed of a hypoallergenic material, and may be constructed of metal, silicone, or a sufficiently flexible plastic. In one embodiment, the body 12 is resiliently flexible such that jewelry 2 may be guided around the body 12 such that the body 12 is flexed during the guiding, as the guiding may be too difficult if the body 12 were too rigid. In some embodiments, the body 12 is constructed by casting, machine stamping, molding, or any other suitable manufacturing process.

The body 12 may be constructed of a hypoallergenic metal or alloy selected from the group consisting of platinum, gold, titanium, copper, stainless steel, a metal alloy substantially free of nickel, silver, sterling silver, and combinations thereof. The body may be plated, filled or coated (e.g., plated with 18-Karat gold). The body 12 may be constructed of a tarnish resistant brass alloy. In one embodiment, the body 12 has a same finish (i.e., gold, silver, or copper) as the jewelry 2 being secured, which may be constructed of, for example, any of the materials disclosed herein. The body 12 may be integrally formed.

Figure 4:
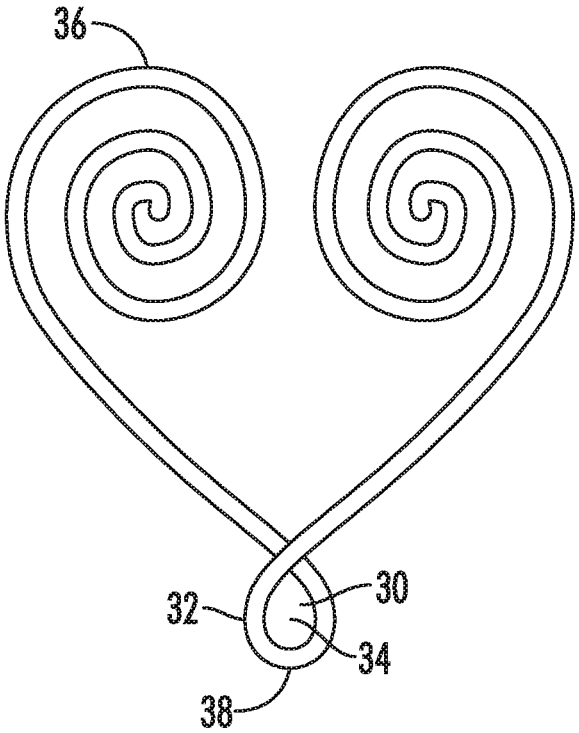
FIG. 4 illustrates a front elevation view of another embodiment of a hook.

In an embodiment of the hook 10, the body 12 includes a first coil 14 on a first end 16 and a second coil 18 on a second end 20. As used herein, "coil" means a length of the body 12 that is arranged in concentric shapes, such as a spiral, shown in FIGS. 1, 2, 4-6, 9, and 10. "Spiral" means a shape that, generally, continuously curves and gradually widens as extending away from a center of the spiral around a central point. The coils 14, 18 may have other concentric shapes, such as squares (FIG. 3A), ovals (FIG. 3B), triangles (FIG. 3C) and the like. Advantageously, each coil 14, 18 allow the jewelry 2, such as a chain neckless, to be securely wound within each coil, positioning a clasp 4 of the jewelry between each coil. The coils 14, 18 secure the chain of the neckless, and provide sufficient surface friction with the wearer to prevent the jewelry from rotationally migrating, particularly preventing the clasp 4 from rotationally migrating from the dorsal neck region (i.e., back of neck) to the ventral region (i.e., front of neck or chest region) of the wearer, while being comfortable and aesthetically pleasing. The coils 14, 18 may include at least two 360° rotations (i.e., a rotation of at least 720°) such that from an initial point on the spiral having an initial direction, the curved spiral repeats the initial direction at least twice. The coils 14, 18 may curve at least 720°, at least 810°, at least 900°, at least 990°, at least 1080° (three rotations), at least 1170°, at least 1260°, or any subrange thereof. The first end 16 and the second end 18 may be disposed on opposite lateral sides of the body 12 such as an outer most lateral curve 22, 24 of the respective coils 14, 16, defines each of the respective first and second ends 14, 18. The coils 14, 18 may curve in the same first direction (e.g., counterclockwise as shown in FIG. 1), or the first coil 14 may curve in a first direction (e.g., clockwise), and the second coil may curve in a second direction opposite of the first direction (e.g., counterclockwise), as shown in FIG. 4. The first and second coils 14, 18 may each define respective first and second gaps 26, 28 configured to securely receive a necklace chain.

The gaps 26, 28 may generally narrow as the coils 14, 18 curve inward. The width of the first and second gaps 26, 28 may vary so as to be slightly larger than the width of the necklace received therein such that the necklace may be guided with and secured within the gaps 26, 28. In an embodiment, the gaps 26, 28 are smaller than the clasp 4 such that the clasp 4 cannot pass through the coils 14, 18, further securing the clasp 4 at the dorsal neck region 6 of the wearer 8.

In an embodiment, the gaps 26, 28 may each narrow between respective first end 16 and second end 20, and respective coil segments 17, 19. The gaps 26, 28 between the first end 16 and the second end 20 and respective coil segments 17, 19 may be dimensioned such that, in order for the clasp 4 to pass through this portion of the gaps 26, 28, the clasp 4 resistably passes or resistably slides (because of contact with the coil segments 17, 19) through this portion of the gaps 26, 28. Advantageously, this securing feature further secures the engaged clasp 4 with the hook 10, as engaged clasp 4 is less likely to pass out of these narrowed portions of the gaps 26, 28 (i.e., become unsecured) once secured.

Figure 5:
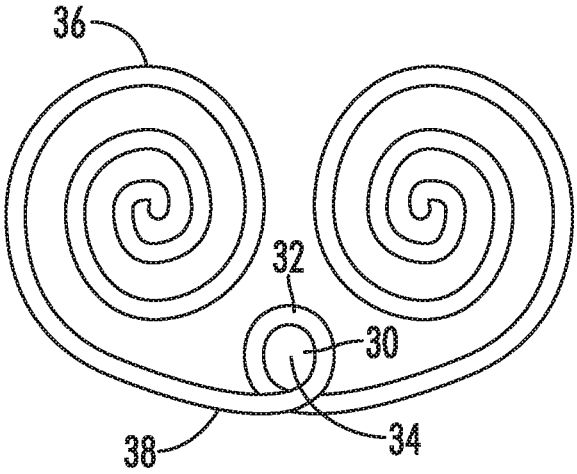
FIG. 5 illustrates a front elevation view of yet another embodiment of a hook.
Figure 6:
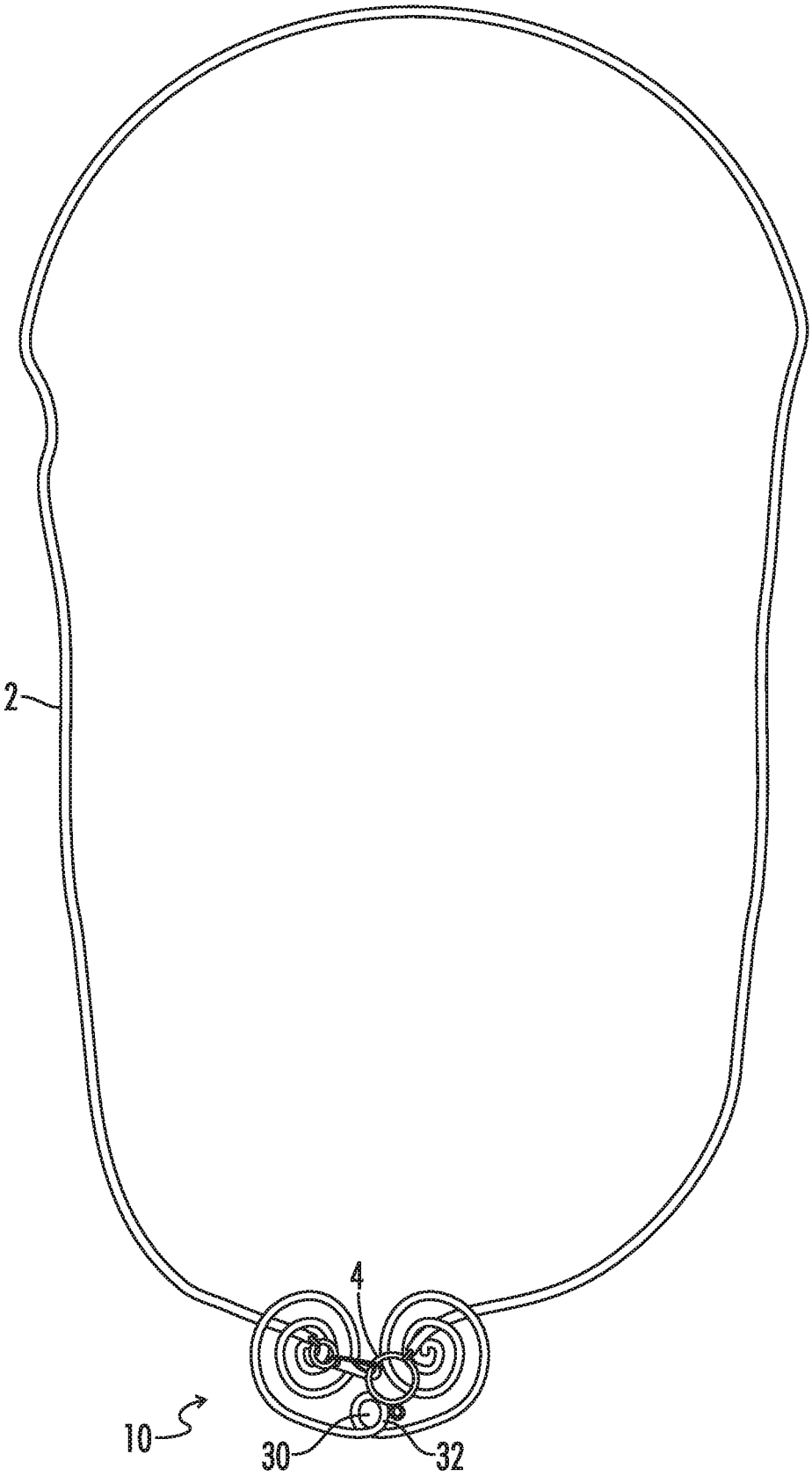
FIG. 6 illustrates the hook of FIG. 5 securing a clasp of a necklace.
Figure 7:
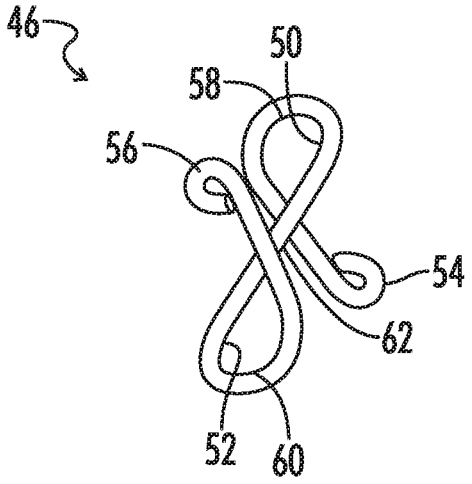
FIG. 7 illustrates front perspective view an embodiment of a base.
Figure 8:
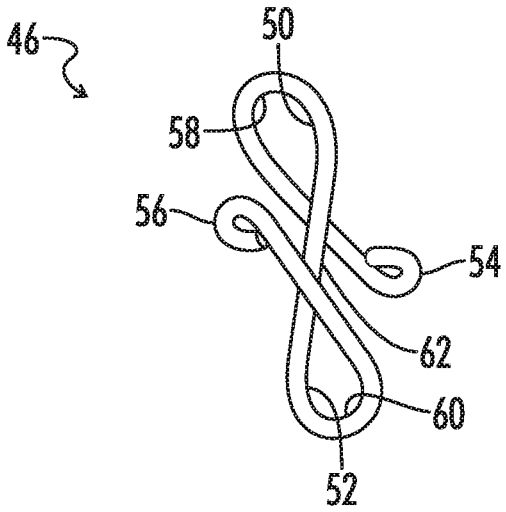
FIG. 8 illustrates a front elevation of the base of FIG. 7.
Figure 9:
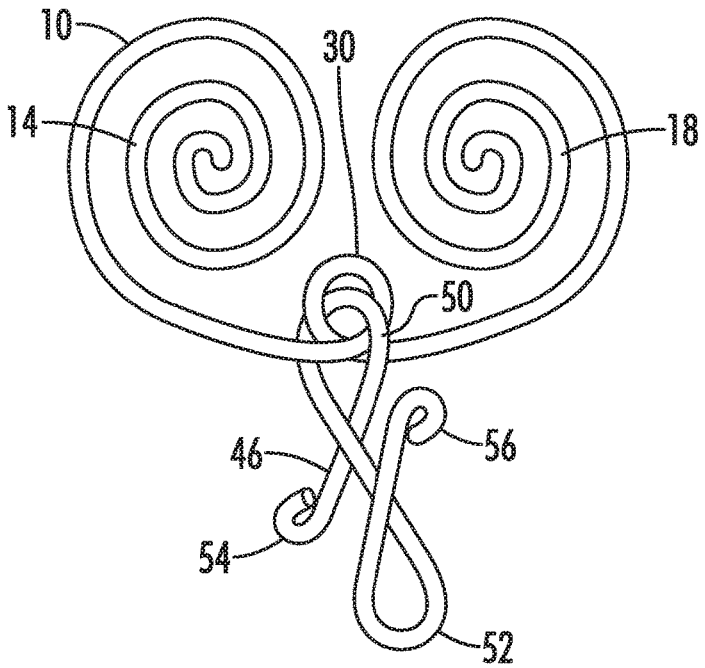
FIG. 9 illustrates a front elevation of the base of FIG. 7 engaged with the hook of FIG. 5.
Figure 10:
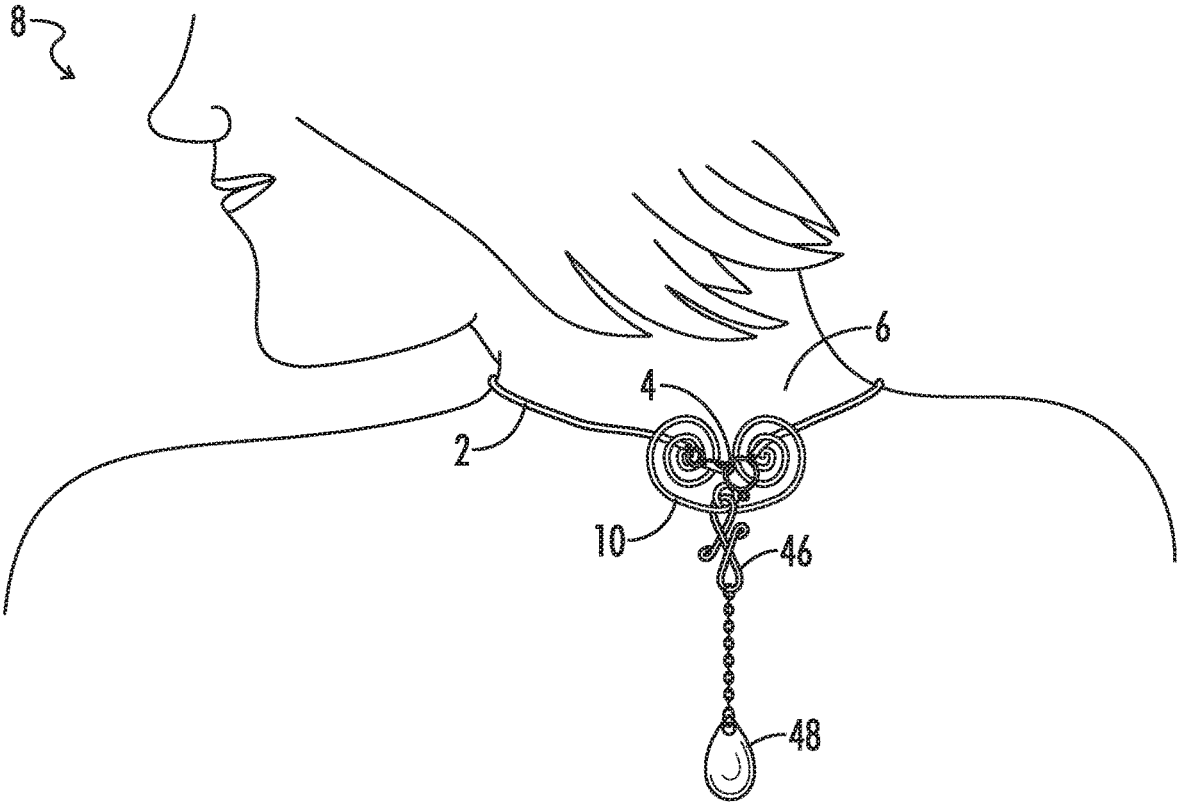
FIG. 10 illustrates an embodiment of an engaged necklace, a hook, a base, and a jewelry accessory worn by a user.

As shown in FIGS. 4-6, the body 12 may include an aperture 30 proximate to the first and second coils 14, 18. In some embodiments, such as those constructed by bending metal wire, the aperture 30 may be defined by a loop 32 of the body 12 around an aperture axis 34. The body 12 may include an upper side 36 and a lower side 38, the upper side 36 positioned toward the head (i.e., anteriorly) when in-use by the wearer. The aperture 30 may be positioned toward, or at, the lower side 38. Laterally, the aperture 30 may be positioned between the first coil 14 and the second coil 18. The aperture 30 may be positioned distal (FIG. 4) or proximal (FIG. 5) to the coils 14, 18.

Figure 2:
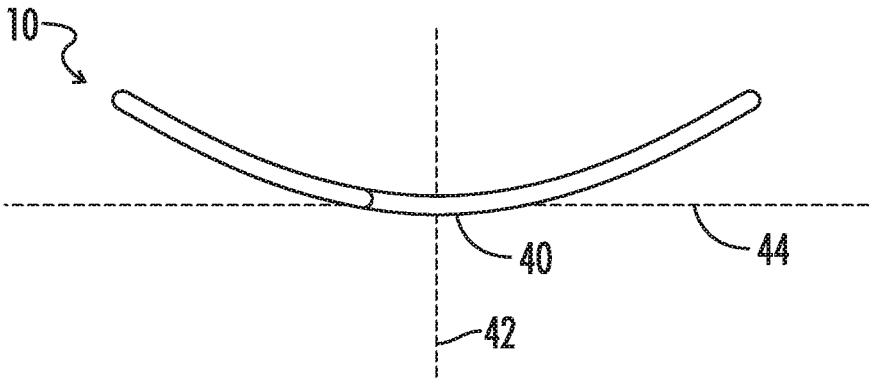
FIG. 2 illustrates a bottom view of the embodiment of the hook of FIG. 1.
Figure 3A:
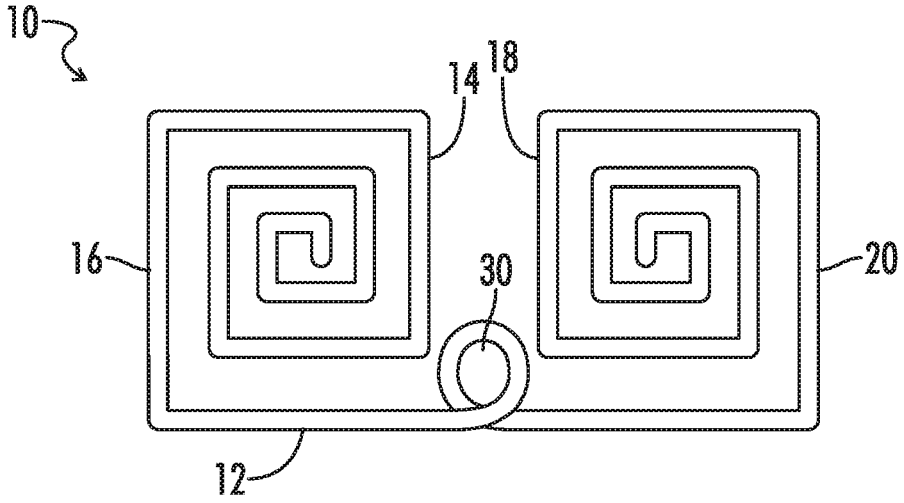
FIGS. 3A-3C illustrate a front elevation view of embodiments of a hook.
Figure 3B:
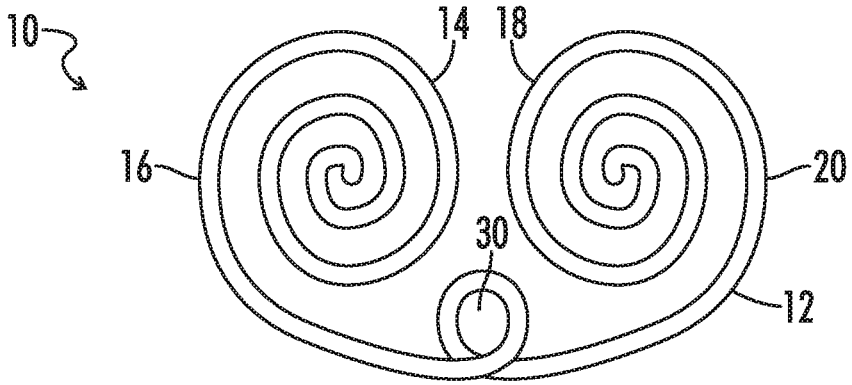
Figure 3C:
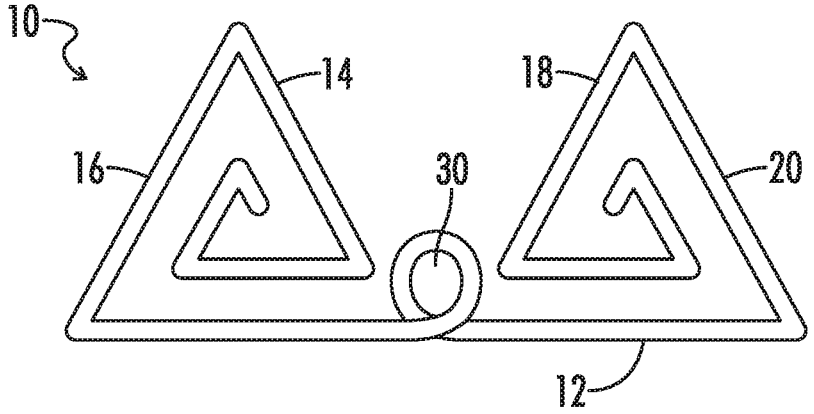

The body 12 may have a curved lateral profile 40 complementary to a surface of a dorsal neck 6 of a human subject, or wearer 8, so that the profile 40 has a curved shape, as shown in FIG. 2. The profile 40 may be described as inwardly curving toward an intersecting center vertical plane 42, or as substantially concave along an intersecting plane 44 extending longitudinally along the body 12. Advantageously, this profile 40 is comfortable for the wearer 8 while providing sufficient surface friction between the body 12 and the neck of the wearer to prevent the body 12, and therefore the clasp 4 of an engaged jewelry 2, from undesirably rotating.

As shown in FIGS. 7-10, a base 46, or a connector 46, is provided. The base 46 may provide an interface between the body 12 (or a chain or clasp 4 of neckless) and a jewelry accessory 48, such as a pendant, shown in FIG. 10. The base 46 may be constructed of any of the materials disclosed for the body 12, and the base 46 may be integrally formed with the body 12 or be discrete and integrally formed as its own component, as shown.

The base 46 may include a first loop 50 and a second loop 52 opposing the first loop 50. Each of the first loop 50 and the second loop 52 may extend to respective terminating ends 54, 56. At least one of the first and second terminating ends 54, 56 may be configured to be received within the aperture 30 of the body 12 such that the aperture 30 of the body 12 may be coupled with a distal end 58 of the first loop 50 of the base 46. A distal end 60 of the second loop 52 may be configured to receive a jewelry accessory 48 such that the jewelry accessory 48 may be coupled with the second loop 52. The terminating ends 54, 56 may be enlarged so as to securely receive the aperture 30 and the jewelry accessory 48. The first loop 50 and the second loop 52 may be directly connected by an intermediary arm 62. The first terminating end 56 and the second terminating end 56 may be on opposite front and back sides of the intermediary arm 62. The first loop 50 and the second loop 52 may be substantial mirror images of each other over a line that extends through the intermediary arm 62. "Substantial mirror images" means exact or almost exact mirror images over a line or point. As embodiments of the connector 46 may be constructed of bendable filaments (and in some embodiments, artisan handcrafted), it is contemplated that the first loop 50 and second loop 52 may not be perfect, or exact, mirror images, but nevertheless recognizable as being substantial mirror images over a line or point.

In an embodiment, a method of securing the necklace 2 is provided. The method comprises providing the necklace 2, providing the hook 10 comprising the body 12 including the first coil 14 and the second coil 18 on the second end 20, and securely engaging the necklace 2 within each of the first coil 14 and the second coil 18. The method may include positioning the body 12 including the clasp 4 of the secured necklace 2 at a dorsal neck region 6 of a subject (i.e., wearer) 8. The clasp 4 may be secured between the first coil 14 and the second coil 18. The hook 10 may comprise the aperture 30. The base 30 may be provided, the base 30 having the first loop 50 and the second loop 52 opposing the first loop 50, wherein each of the first loop 50 and the second loop 52 extend to respective terminating ends 54, 56. The method may include inserting the terminating end 54 of the first loop 50 within the aperture 30 of the body 12. The method may include guiding the base 46 within the aperture 30 such that the first loop 50 intersects with the aperture 30. The method may include securely coupling the jewelry accessory 48 with the second loop 52.

Thus, although there have been described particular embodiments of the present invention of new and useful Apparatus And Methods For Securing Jewelry, it is not intended that such references be construed as limitations upon the scope of this invention except as set forth in the following claims.

What is claimed is:

1. A hook, comprising:

a body including a first coil on a first end;

a second coil on a second end, wherein each of the first coil and the second coil include at least two 360° rotations; and an aperture proximate to the first coil and the second coil.

2. The hook of claim 1, wherein the first coil includes a first spiral and the second coil includes a second spiral.

3. The hook of claim 2, wherein the first coil curves in a first direction and the second coil curves in a second direction opposite of the first direction.

4. The hook of claim 1, wherein the body is constructed of a metal filament.

5. The hook of claim 4, wherein the metal filament is constructed of a hypoallergenic metal or alloy selected from the group consisting of platinum, gold, titanium, copper, stainless steel, a metal alloy substantially free of nickel, silver, sterling silver, and combinations thereof.

6. The hook of claim 1, wherein the first coil is disposed on a first end and the second coil is disposed on a second end opposite of the first end.

7. The hook of claim 1, wherein the body comprises an upper side and a lower side, and wherein the aperture is disposed on the lower side and between the first coil and the second coil.

8. The hook of claim 1, wherein the aperture is defined by a loop of the body around an axis.

9. The hook of claim 1, further comprising a base disposed within the aperture, the base including a first loop and a second loop opposing the first loop, wherein each of the first loop and the second loop extends to respective terminating ends, wherein at least one of the terminating ends is configured to be received within the aperture such that the aperture of the body may be coupled with a distal end of the first loop of the base.

10. The hook of claim 1, wherein each of the first coil and the second coil include at least two-and-a-quarter 360° rotations.

11. The hook of claim 1, wherein the body has a profile complementary to the profile of a dorsal neck of a human subject.

12. The hook of claim 1, wherein the first coil and the second coil each define a gap configured to securely receive a necklace chain.

13. A method of securing a necklace having a clasp, comprising:

providing a necklace;

providing a hook including a body, the body comprising a first coil on a first end, a second coil on a second end, and an aperture proximate to the first coil and the second coil; and securely engaging the necklace within each of the first coil and the second coil of the body.

14. The method of claim 13, further comprising positioning the body including the secured clasp at a dorsal neck region of a subject.

15. The method of claim 13, wherein the clasp is secured between the first coil and the second coil.

16. The method of claim 13, further comprising:

providing a base including a first loop and a second loop opposing the first loop, wherein each of the first loop and the second loop extend to respective terminating ends;

inserting the terminating end of the first loop within the aperture of the body; and guiding the base within the aperture such that the first loop intersects with the aperture.

17. The method of claim 16, further comprising coupling a jewelry accessory with the second loop.

* * * * *